US008815029B2

(12) United States Patent
Lund et al.

(10) Patent No.: US 8,815,029 B2
(45) Date of Patent: Aug. 26, 2014

(54) HIGH PERFORMANCE GAS GENERATING COMPOSITIONS

(75) Inventors: Gary K. Lund, Malad City, ID (US); Roger Bradford, Malad City, ID (US)

(73) Assignee: Autoliv ASP, Inc., Ogden, UT (US)

( * ) Notice: Subject to any disclaimer, the term of this patent is extended or adjusted under 35 U.S.C. 154(b) by 1057 days.

(21) Appl. No.: 12/269,340

(22) Filed: Nov. 12, 2008

(65) Prior Publication Data

US 2009/0255611 A1 Oct. 15, 2009

Related U.S. Application Data

(60) Provisional application No. 61/043,909, filed on Apr. 10, 2008.

(51) Int. Cl.
*C06B 21/00* (2006.01)

(52) U.S. Cl.
USPC ..... 149/109.6

(58) Field of Classification Search
USPC ..... 149/109.6
See application file for complete search history.

(56) References Cited

U.S. PATENT DOCUMENTS

| | | | | |
|---|---|---|---|---|
| 2,921,521 | A | 1/1960 | La Haye et al. | 102/39 |
| 3,255,281 | A | 6/1966 | Alexander | 264/3 |
| 3,722,354 | A | 3/1973 | Herty, III | 86/1 |
| 3,724,870 | A | 4/1973 | Kurokawa et al. | 280/150 |
| 3,912,561 | A | 10/1975 | Doin et al. | |
| 3,986,908 | A | 10/1976 | Grebert et al. | 149/19.7 |
| 4,000,231 | A | 12/1976 | Peterson | |
| 4,099,376 | A | 7/1978 | Japs | 60/253 |
| 4,131,051 | A | 12/1978 | Schaffling | 86/1 R |
| 4,246,051 | A | 1/1981 | Garner et al. | |
| 4,300,962 | A | 11/1981 | Stinecipher et al. | |
| 4,349,324 | A | 9/1982 | Neff et al. | |
| 4,608,102 | A | 8/1986 | Krampen et al. | |
| 4,624,126 | A | 11/1986 | Avila et al. | |
| 4,632,813 | A | 12/1986 | Anastasi et al. | |
| 4,640,711 | A | 2/1987 | Lichti et al. | |
| 4,698,107 | A | 10/1987 | Goetz et al. | |
| 4,714,579 | A | 12/1987 | Boden et al. | |
| 4,806,180 | A | 2/1989 | Goetz et al. | |

(Continued)

FOREIGN PATENT DOCUMENTS

| | | |
|---|---|---|
| CN | 1303338 A | 7/2001 |
| CN | 101506125 | 8/2009 |

(Continued)

OTHER PUBLICATIONS

"Extrusion Process," retrieved from http://www.aec.org/techinfo/prntFriend/expro_prntfrnd.html, 4pp. (downloaded on Oct. 6, 2006).

(Continued)

*Primary Examiner* — Aileen B Felton
(74) *Attorney, Agent, or Firm* — Harness, Dickey & Pierce, P.C.

(57) ABSTRACT

Compositions and methods relating to gas generants used in inflatable restraint systems. The gas generant grains formed via spray drying techniques of the present disclosure provide superior performance, including high burn rates and high gas yields. Further, processing of the gas generant grain products can be streamlined. Such gas generants include by way of non-limiting example, guanidine nitrate, basic copper nitrate, and a secondary oxidizer, such as potassium perchlorate.

19 Claims, 5 Drawing Sheets

(56) References Cited

U.S. PATENT DOCUMENTS

| | | | | |
|---|---|---|---|---|
| 4,817,828 | A | 4/1989 | Goetz | |
| 4,828,474 | A | 5/1989 | Ballantyne | |
| 4,846,368 | A | 7/1989 | Goetz | |
| 4,923,512 | A | 5/1990 | Timm et al. | |
| 4,944,528 | A | 7/1990 | Nilsson et al. | 280/741 |
| 4,948,439 | A | 8/1990 | Poole et al. | |
| 4,998,751 | A | 3/1991 | Paxton et al. | |
| 5,019,220 | A | 5/1991 | Taylor et al. | |
| 5,034,070 | A | 7/1991 | Goetz et al. | |
| 5,035,757 | A | 7/1991 | Poole | |
| 5,051,143 | A | 9/1991 | Goetz | |
| 5,074,938 | A | 12/1991 | Chi | |
| 5,139,588 | A | 8/1992 | Poole | |
| 5,202,067 | A | 4/1993 | Solazzi et al. | |
| 5,345,873 | A | 9/1994 | Lauritzen et al. | |
| 5,351,619 | A | 10/1994 | Chan et al. | |
| 5,388,519 | A | 2/1995 | Guindon et al. | |
| 5,407,608 | A | 4/1995 | Knowlden et al. | |
| 5,423,261 | A | 6/1995 | Bernardy et al. | |
| 5,460,668 | A | 10/1995 | Lyon | |
| 5,507,520 | A | 4/1996 | Meduvsky et al. | |
| 5,507,890 | A | 4/1996 | Swann et al. | |
| 5,518,054 | A | 5/1996 | Mitson et al. | |
| 5,531,941 | A | 7/1996 | Poole | |
| 5,538,568 | A | 7/1996 | Taylor et al. | |
| 5,542,704 | A | 8/1996 | Hamilton et al. | |
| 5,562,303 | A | 10/1996 | Schleicher et al. | 280/736 |
| 5,565,710 | A | 10/1996 | Ochi et al. | |
| 5,608,183 | A | 3/1997 | Barnes et al. | |
| 5,623,115 | A | 4/1997 | Lauritzen et al. | 102/288 |
| 5,629,494 | A | 5/1997 | Barnes et al. | |
| 5,635,668 | A | 6/1997 | Barnes et al. | |
| 5,670,740 | A | 9/1997 | Barnes et al. | |
| 5,682,013 | A | 10/1997 | Smith et al. | |
| 5,738,374 | A | 4/1998 | Marsaud et al. | 280/741 |
| 5,756,929 | A | 5/1998 | Lundstrom et al. | |
| 5,756,930 | A | 5/1998 | Chan et al. | |
| 5,780,767 | A | 7/1998 | Matsuda et al. | |
| 5,804,758 | A | 9/1998 | Marsaud et al. | 102/288 |
| 5,821,449 | A | 10/1998 | Langsjoen et al. | |
| 5,834,679 | A | 11/1998 | Seeger | |
| 5,879,421 | A | 3/1999 | Liu et al. | |
| 5,985,361 | A | 11/1999 | Poulter et al. | |
| 5,989,367 | A | 11/1999 | Zeuner et al. | |
| 6,007,736 | A | 12/1999 | Zhang et al. | |
| 6,029,994 | A | 2/2000 | Perotto et al. | 280/736 |
| 6,032,979 | A | 3/2000 | Mossi et al. | 280/741 |
| 6,039,820 | A | 3/2000 | Hinshaw et al. | |
| 6,053,110 | A | 4/2000 | Marchant et al. | |
| 6,103,030 | A | 8/2000 | Taylor et al. | |
| 6,129,023 | A | 10/2000 | Marsaud et al. | |
| 6,132,480 | A | 10/2000 | Barnes et al. | |
| 6,132,537 | A | 10/2000 | Zeuner et al. | |
| 6,143,102 | A | 11/2000 | Mendenhall et al. | |
| 6,156,136 | A | 12/2000 | Bottaro et al. | |
| 6,205,916 | B1 | 3/2001 | Castleton | |
| 6,214,138 | B1 | 4/2001 | Canterberry et al. | |
| 6,224,697 | B1 | 5/2001 | Mendenhall et al. | |
| 6,301,935 | B1 | 10/2001 | Audenaert et al. | |
| 6,315,930 | B1 | 11/2001 | Hamilton | |
| 6,322,649 | B1 | 11/2001 | Marsaud et al. | |
| 6,368,434 | B1 | 4/2002 | Espagnacq et al. | |
| 6,427,599 | B1 | 8/2002 | Posson et al. | |
| 6,517,647 | B1 | 2/2003 | Yamato | 149/45 |
| 6,550,808 | B1 | 4/2003 | Mendenhall | |
| 6,592,691 | B2 | 7/2003 | Taylor et al. | |
| 6,605,233 | B2 | 8/2003 | Knowlton et al. | |
| 6,620,266 | B1 | 9/2003 | Williams et al. | |
| 6,634,302 | B1 | 10/2003 | Rink et al. | |
| 6,688,231 | B1 | 2/2004 | Herrmann | |
| 6,689,237 | B1 | 2/2004 | Mendenhall | |
| 6,712,918 | B2 | 3/2004 | Mendenhall et al. | |
| 6,752,939 | B2 | 6/2004 | Gereg | |
| 6,789,485 | B2 | 9/2004 | Moquin et al. | 102/530 |
| 6,843,869 | B2 | 1/2005 | Mendenhall et al. | |
| 6,905,562 | B2 | 6/2005 | Hamilton | |
| 6,935,655 | B2 | 8/2005 | Longhurst et al. | |
| 6,941,868 | B2 | 9/2005 | Herget | |
| 6,958,101 | B2 | 10/2005 | Mendenhall et al. | |
| 6,984,398 | B2 | 1/2006 | Brennan et al. | |
| 7,024,342 | B1 | 4/2006 | Waite et al. | |
| 7,077,428 | B2 | 7/2006 | Barker et al. | |
| 7,147,733 | B2 | 12/2006 | Barnes et al. | |
| 7,470,337 | B2 | 12/2008 | Mendenhall et al. | |
| 7,618,506 | B2 | 11/2009 | Yokoyama et al. | |
| 7,758,709 | B2 | 7/2010 | Hussey et al. | |
| 7,814,838 | B2 | 10/2010 | McCormick | |
| 8,057,610 | B2 | 11/2011 | Hussey et al. | |
| 8,057,611 | B2 | 11/2011 | Brisighella et al. | |
| 8,057,612 | B2 | 11/2011 | Brisighella et al. | |
| 2002/0195181 | A1 | 12/2002 | Lundstrom et al. | |
| 2003/0037850 | A1 | 2/2003 | Helmy et al. | |
| 2004/0000362 | A1 | 1/2004 | Sato et al. | |
| 2004/0050283 | A1 | 3/2004 | Daoud | |
| 2004/0112244 | A1 | 6/2004 | Barker et al. | |
| 2004/0173922 | A1 | 9/2004 | Barnes et al. | |
| 2004/0216820 | A1 | 11/2004 | Mendenhall et al. | |
| 2005/0067076 | A1 | 3/2005 | Barnes et al. | |
| 2005/0115721 | A1 | 6/2005 | Blau et al. | |
| 2005/0263223 | A1 | 12/2005 | Halpin et al. | |
| 2006/0016529 | A1* | 1/2006 | Barnes et al. | 149/45 |
| 2006/0054257 | A1 | 3/2006 | Mendenhall et al. | |
| 2006/0102259 | A1 | 5/2006 | Taylor et al. | |
| 2006/0289096 | A1* | 12/2006 | Mendenhall et al. | 149/19.1 |
| 2007/0084531 | A1 | 4/2007 | Halpin et al. | |
| 2007/0240797 | A1 | 10/2007 | Mendenhall et al. | |
| 2007/0277915 | A1 | 12/2007 | Hordos | |
| 2007/0296190 | A1 | 12/2007 | Hussey et al. | |
| 2008/0236711 | A1 | 10/2008 | Bradford et al. | |
| 2009/0205757 | A1 | 8/2009 | Gaudre et al. | |
| 2009/0308509 | A1 | 12/2009 | Marlin | |
| 2010/0116384 | A1 | 5/2010 | Mendenhall et al. | |
| 2011/0025030 | A1 | 2/2011 | Mendenhall et al. | |

FOREIGN PATENT DOCUMENTS

| | | |
|---|---|---|
| CN | 101622212 | 1/2010 |
| CN | 101952227 | 1/2011 |
| CN | 102216242 | 10/2011 |
| DE | 3933555 | 2/1991 |
| DE | 4006741 | 8/1991 |
| DE | 4318883 | 12/1993 |
| DE | 19501889 | 7/1995 |
| EP | 0324639 | 7/1989 |
| EP | 0728630 | 8/1996 |
| EP | 0757026 | 2/1997 |
| EP | 0767155 | 4/1997 |
| EP | 0870746 | 10/1998 |
| EP | 1118512 | 7/2001 |
| EP | 1142853 | 10/2001 |
| EP | 2035352 | 3/2009 |
| EP | 2129641 | 12/2009 |
| EP | 2190801 | 6/2010 |
| EP | 2265562 | 12/2010 |
| EP | 2346797 | 7/2011 |
| FR | 2873367 | 1/2006 |
| GB | 2219242 | 12/1989 |
| JP | 2010522687 | 7/2010 |
| JP | 2010536691 | 12/2010 |
| JP | 2011516395 | 5/2011 |
| WO | WO 89/10257 | 11/1989 |
| WO | WO 99/05079 | 2/1999 |
| WO | WO 01/08937 | 2/2001 |
| WO | WO 2003/106378 | 12/2003 |
| WO | WO 2004/024653 | 3/2004 |
| WO | WO 2004/067477 | 8/2004 |
| WO | WO 2006/134311 | 12/2006 |
| WO | WO 2007/042735 | 4/2007 |
| WO | WO 2007/113299 | 10/2007 |
| WO | WO 2007/149173 | 12/2007 |
| WO | WO 2008/035288 | 3/2008 |
| WO | WO 2008/051274 | 5/2008 |
| WO | WO 2008/118273 | 10/2008 |
| WO | WO 2009/023119 | 2/2009 |

(56) References Cited

FOREIGN PATENT DOCUMENTS

| | | |
|---|---|---|
| WO | WO 2009/126182 | 10/2009 |
| WO | WO 2009/126702 | 10/2009 |
| WO | WO 2010/056512 | 5/2010 |
| WO | WO 2011/017192 | 2/2011 |

OTHER PUBLICATIONS

"Refinement of tablet compaction models to include compaction kinematics," retrieved from http://www.msm.cam.ac.uk/ccmm/projects/lhh24.html, 6 pp. (downloaded on Sep. 18, 2006).
Kent, Richard, et al., "The Use of MADYMO to Elucidate Injury Mechanisms in a Complex, Multi-Impact Collision," retrieved from http://www-nrd.nhtsa.dot.gov/pdf/nrd-50/ciren/2002/0802fairfax.pdf, 32 pp. (downloaded on Feb. 5, 2008).
Web page, 1995-2008 Cabot Corporation, Overview of CAB-O-SIL® Untreated Fumed Silicas, http://www.cabot-corp.com/cws/businesses.nsf/CWSID/cswBUS01182001034300PM9596?_OpenDocument, downloaded Oct. 27, 2008, 1 page.
Web page, Fibertec Inc., Fibertec Functional Fillers—Microglass Milled Glass Fibers, http://www.fibertecinc.com/microglass.htm, downloaded Oct. 27, 2008, 3 pages.
Web page, U.S. Silica Company, MIN-U-SIL® 40, Jan. 7, 1999, http://www.u-s-silica.com/PDS/Berkley?BerMUS4020000.PDF, downloaded Nov. 10, 2008, 1 page.
The International Search Report and Written Opinion of the International Searching Authority issued on May 18, 2009 for PCT International Application No. PCT/US09/39895 (published as WO 2009/126702).
The International Preliminary Report on Patentability issued on Oct. 12, 2010 for PCT International Application No. PCT/US09/39895 (published as WO 2009/126702).
The International Search Report and Written Opinion of the International Searching Authority issued on Sep. 25, 2009 for cross-referenced PCT International Application No. PCT/US08/79750 (published as WO 09/126182).
The International Preliminary Report on Patentability issued on Oct. 12, 2010 for cross-referenced PCT International Application No. PCT/US08/79750 (published as WO 09/126182).
The International Search Report and Written Opinion of the International Searching Authority issued on Jul. 3, 2008 for PCT International Application No. PCT/US07/012169 (published as WO 2007/149173).
The International Preliminary Report on Patentability issued on Dec. 22, 2008 for PCT International Application No. PCT/US07/012169 (published as WO 2007/149173).
The International Search Report and Written Opinion issued on Jul. 30, 2009 for PCT International Application No. PCT/US2008/009472 (published as WO 2009/023119).
The International Preliminary Report on Patentability issued on Feb. 16, 2010 for International Application No. PCT/US2008/009472 (published as WO 2009/023119).
The International Search Report and Written Opinion of the International Searching Authority issued on Sep. 13, 2010 for International Application No. PCT/US2010/043718 (published as WO 2011/017192).
The International Search Report and Written Opinion of the International Searching Authority issued on Dec. 22, 2009 for International Application No. PCT/US09/62223 (published as WO 2010/056512).
The International Preliminary Report on Patentability issued on May 17, 2011 for International Application No. PCT/US09/62223 (published as WO 2010/056512).
The International Search Report and Written Opinion of the International Searching Authority issued on Sep. 18, 2008 for International Application No. PCT/US08/02654 (published as WO 08/118273).
The International Preliminary Report on Patentability issued on Sep. 29, 2009 for International Application No. PCT/US08/02654 (published as WO 08/118273).
The European Search Opinion and Supplementary European Search Report issued on Oct. 1, 2009 for European Patent Application No. 07795162.2 (published as EP 2035352).
Communication issued by the European Patent Office on Mar. 31, 2010 in European Patent Application No. 07795162.2 (published as EP 2035352).
Applicants' Response to Communication issued by the European Patent Office on Mar. 31, 2010 in European Patent Application No. 07795162.2 (published as EP 2035352) filed on Sep. 22, 2010.
Notification of the First Office Action issued by the State Intellectual Property Office of the People's Republic of China on Mar. 9, 2011 in Chinese Patent Application No. 200780031197.3 (published as CN 101506125).
Communication issued by the European Patent Office on Jan. 19, 2011 in European Patent Application No. 08795096.0 (published as EP 2190801 A0).
Applicants' Response to Communication from the European Examining Division dated Jan. 19, 2011 in European Patent Application No. 08795096.0 (published as EP 2190801 A0) filed on Apr. 28, 2011.
Communication issued by the European Patent Office on Feb. 22, 2011 in European Patent Application No. 08742004.8.
Applicants' Response to Communication issued by the European Patent Office on Feb. 22, 2011 in European Patent Application No. 08742004.8 filed Aug. 8, 2011.
Non-Final Office Action dated Sep. 29, 2009 issued in co-pending cross-referenced U.S. Appl. No. 11/691,753.
Applicants' Response to Non-Final Office Action dated Sep. 29, 2009 issued in co-pending cross-referenced U.S. Appl. No. 11/691,753, filed Dec. 29, 2009.
Final Office Action dated Mar. 9, 2010 issued in co-pending cross-referenced U.S. Appl. No. 11/691,753.
Applicants' Reply to Final Office Action dated Mar. 9, 2010 issued in co-pending cross-referenced U.S. Appl. No. 11/691,753, filed May 10, 2010.
Advisory Action dated May 25, 2010 issued in co-pending cross-referenced U.S. Appl. No. 11/691,753.
Applicants' Request for Continued Examination and Response to Advisory Action dated May 25, 2010 issued in co-pending cross-referenced U.S. Appl. No. 11/691,753, filed Jul. 9, 2010.
Non-Final Office Action dated Jul. 29, 2010 issued in co-pending cross-referenced U.S. Appl. No. 11/691,753.
Applicants' Response to Non-Final Office Action dated Jul. 29, 2010 issued in co-pending cross-referenced U.S. Appl. No. 11/691,753, filed Dec. 29, 2010.
Final Office Action dated Feb. 1, 2011 issued in co-pending cross-referenced U.S. Appl. No. 11/691,753.
Applicants' Reply to Final Office Action dated Feb. 1, 2011 issued in co-pending cross-referenced U.S. Appl. No. 11/691,753, filed Apr. 1, 2011.
Interview Summary and Advisory Action dated Apr. 26, 2011 issued in co-pending cross-referenced U.S. Appl. No. 11/691,753.
Applicants' Response to Interview Summary dated Apr. 26, 2011 issued in co-pending cross-referenced U.S. Appl. No. 11/691,753, filed May 24, 2011.
Applicants' Notice of Appeal filed on Jun. 1, 2011 in co-pending cross-referenced U.S. Appl. No. 11/691,753.
Applicants' Appeal Brief filed on Aug. 1, 2011 in co-pending cross-referenced U.S. Appl. No. 11/691,753.
Applicants' Amended Appeal Brief filed on Sep. 30, 2011 in co-pending cross-referenced U.S. Appl. No. 11/691,753.
Examiner's Answer to Appeal Brief dated Jan. 5, 2012 issued in co-pending cross-referenced U.S. Appl. No. 11/691,753.
Office Action dated Nov. 8, 2010 issued in co-pending cross-referenced U.S. Appl. No. 12/269,333 (U.S. Pub. No. 2010-0116384).
Applicants' Response to Office Action dated Nov. 8, 2010 issued in co-pending cross-referenced U.S. Appl. No. 12/269,333, filed Dec. 8, 2010.
Non-Final Office Action dated Dec. 16, 2010 issued in co-pending cross-referenced U.S. Appl. No. 12/269,333.
Applicants' Response to Non-Final Office Action dated Dec. 16, 2010 issued in co-pending cross-referenced U.S. Appl. No. 12/269,333, filed Mar. 16, 2011.

(56) References Cited

OTHER PUBLICATIONS

Final Office Action dated Apr. 7, 2011 issued in co-pending cross-referenced U.S. Appl. No. 12/269,333.

Applicants' Reply to Final Office Action dated Apr. 7, 2011 issued in co-pending cross-referenced U.S. Appl. No. 12/269,333, filed Jun. 7, 2011.

Advisory Action dated Jun. 20, 2011 issued in co-pending cross-referenced U.S. Appl. No. 12/269,333.

Applicants' Notice of Appeal and Pre-Appeal Brief Request for Review filed on Aug. 8, 2011 in co-pending cross-referenced U.S. Appl. No. 12/269,333.

Notice of Panel Decision from Pre-Appeal Brief Review dated Oct. 5, 2011 issued in co-pending cross-referenced U.S. Appl. No. 12/269,333.

Applicants' Appeal Brief filed on Dec. 5, 2011 in co-pending cross-referenced U.S. Appl. No. 12/269,333.

* cited by examiner

HIGH PERFORMANCE GAS GENERATING COMPOSITIONS

CROSS-REFERENCE TO RELATED APPLICATIONS

This application claims the benefit of U.S. Provisional Application No. 61/043,909 filed on Apr. 10, 2008, the entire disclosure of which is incorporated herein by reference in its entirety.

FIELD

The present disclosure generally relates to inflatable restraint systems and more particularly to pyrotechnic gas-generating compositions for use in such systems.

INTRODUCTION

The statements in this section provide background information related to the present disclosure and may not constitute prior art.

Passive inflatable restraint systems are used in a variety of applications, such as motor vehicles. Certain types of passive inflatable restraint systems minimize occupant injuries by using a pyrotechnic gas generant to inflate an airbag cushion (e.g., gas initiators and/or inflators) or to actuate a seatbelt tensioner (e.g., micro gas generators), for example. Automotive airbag inflator performance and safety requirements continually increase to enhance passenger safety.

Gas generant and initiator material selection involves addressing various factors, including meeting current industry performance specifications, guidelines and standards, generating safe gases or effluents, handling safety of the gas generant materials, durational stability of the materials, and cost-effectiveness in manufacture, among other considerations. It is preferred that the pyrotechnic compositions are safe during handling, storage, and disposal. Further, it is preferable that the pyrotechnic material compositions are azide-free.

Improved gas generant performance with respect to gas yield, relative quickness as determined by observed burning rate, and cost are important variables in inflator gas generant design. For example, increases in burning rate or gas yield of gas generants, may be achieved by incorporation of new and/or exotic compositions, which are often expensive. Such compositions are typically processed by admixing finely ground particles in order to produce the generant, which is then further pelletized or otherwise fashioned into a grain for controlling ballistic output.

It is desirable to produce a gas generant having a high gas yield and a high burning rate (e.g., greater than or equal to 1 inch per second at 3,000 pounds per square inch) without resorting to expensive ingredients such as tetrazoles, bitetrazoles, and the like, all the while employing traditional fabrication and process methods. A further advantage of relatively high burning rates is that this property allows the generant to be utilized in inflator applications requiring very high speed responses, such as for side impact applications. In addition, high burning rate gas generants can allow grain designs with tailored ballistic performance to be applied to advanced inflator applications, for example, such as those required for out-of-place occupants, and similar requirements.

SUMMARY

In various aspects, the present disclosure provides methods for making a gas generant and the compositions produced thereby. In certain aspects, methods for making a gas generant comprise spray drying an aqueous mixture to produce a powder. The aqueous mixture comprises guanidine nitrate, basic copper nitrate, and about 1% to about 30% by weight of a secondary oxidizer. Then the powder is pressed to a gas generant grain. In certain aspects, the methods further comprise forming the aqueous mixture prior to spray drying by combining the guanidine nitrate, basic copper nitrate, and the secondary oxidizer. A gas generant grain made according to the methods of the present disclosure has a burning rate at least about 20% greater than a comparative burn rate of a comparative gas generant grain having substantially the same composition and produced by a process selected from the group consisting of: roll compacting, milling, and/or mechanical mixing.

In various aspects, a gas generant grain is formed that comprises guanidine nitrate, basic copper nitrate, and about 1% to about 30% by weight of a secondary oxidizer comprising potassium perchlorate. The gas generant grain has an average linear burn rate of greater than or equal to about 1.5 inches per second (about 38.1 mm per second). Further, in accordance with the present disclosure, the gas yield of the gas generant is relatively high.

In yet other aspects, a method for making a gas generant comprises spray drying an aqueous mixture via a single orifice fountain nozzle to produce a powder. The aqueous mixture comprises guanidine nitrate, basic copper nitrate, and about 1% to about 30% by weight of a secondary oxidizer. Then the powder is pressed to produce a gas generant grain having an average linear burn rate of greater than or equal to about 1.5 inches per second (about 38.1 mm per second) at a pressure of about 3,000 pounds per square inch (about 20,685 kPa).

The present methods and gas generant grains provide several advantages and benefits. By way of non-limiting example, these include the fact that the resultant gas generants can be azide-free, thereby minimizing toxicity potentially associated with azide compounds. The present disclosure also provides fast burning gas generants using lower cost, less expensive materials, which have comparable burn and gas yield rates as gas generants made with more expensive components, such as tetrazoles and bitetrazoles. In addition, spray dried powders made using the methods of the present disclosure may be more easily pressed into complex grains, as well as tablets or pellets, and the resulting grains may have fewer chips and voids.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DETAILED DESCRIPTION

The following description is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom.

The present disclosure is drawn to compositions and methods for making a gas generant. An aqueous mixture including guanidine nitrate, basic copper nitrate, and from about 1% to 30% by weight of a secondary oxidizer, along with an optional slag promoting agent such as silicon dioxide, is spray dried to produce a powder. The powder is pressed to produce grains of the gas generant. In some embodiments, the methods further include forming an aqueous mixture including guanidine nitrate, basic copper nitrate, and from about 1% to 30% by weight of a secondary oxidizer, which includes adding the guanidine nitrate in an aqueous medium to substantially dissolve it. In certain embodiments, the basic copper nitrate and secondary oxidizer are then added to the aqueous medium which is mixed to form the aqueous mixture for spray drying.

Methods for making a gas generant comprise forming an aqueous mixture including guanidine nitrate, basic copper nitrate, and from about 1% to 30% by weight of a secondary oxidizer. In certain aspects, the aqueous mixture also includes about 0.1% to about 5.0% of a slag promoting agent, such as silicon dioxide. The aqueous mixture is spray dried to produce a powder and the powder is pressed to produce grains of the gas generant. The secondary oxidizer may be a perchlorate salt, such as potassium perchlorate. The grains of gas generant may provide a burning rate at least about 20% greater than a gas generant produced by mechanically blending the components followed by roll compacting and milling the same amounts of guanidine nitrate, basic copper nitrate, and secondary oxidizer or a gas generant produced by mechanically blending the same amount of secondary oxidizer into a spray dried mixture of the same amounts of basic copper nitrate and guanidine nitrate. The gas generant may be used in devices and systems to inflate an airbag cushion or to actuate a seatbelt tensioner, for example.

Inflatable restraint devices are used in various types of restraint systems including seatbelt pretensioning systems and airbag module assemblies. These devices and systems may be used in multiple applications in automotive vehicles, such as driver-side, passenger-side, side-impact, curtain, and carpet airbag assemblies. Other types of vehicles including, for example, boats, airplanes, and trains may use inflatable restraints. In addition, other types of safety or protective devices may also employ various forms of inflatable restraints.

Figure 1:
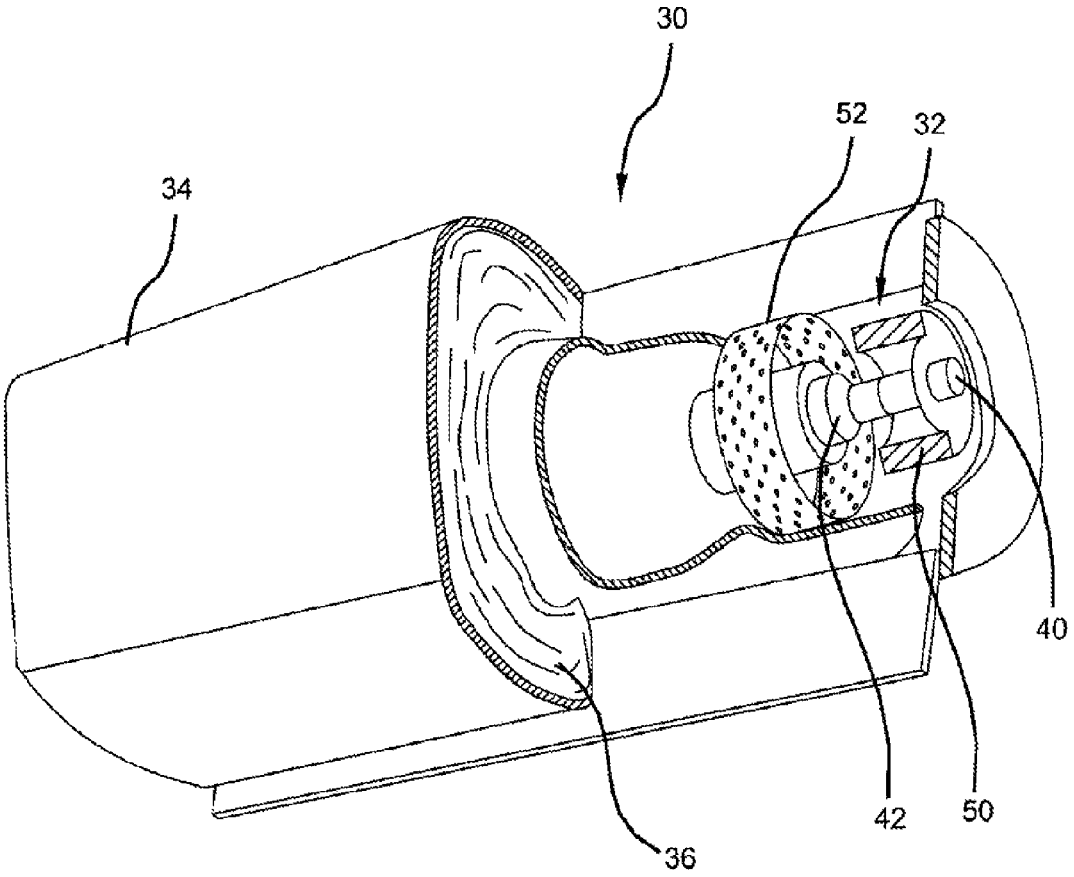
FIG. 1 is a partial cross-sectional view of an embodiment of a passenger-side airbag module including an inflator for an inflatable airbag restraint device.

Inflatable restraint devices typically involve a series of reactions, which facilitate production of gas, to deploy an airbag or actuate a piston. In the case of airbags, upon actuation of the airbag assembly system, the airbag cushion should begin to inflate within a few milliseconds. With reference to FIG. 1, a typical airbag module 30 includes a passenger compartment inflator assembly 32 and a covered compartment 34 to store an airbag 36. Such devices often use a squib or initiator 40 that is electrically ignited when rapid deceleration and/or collision is sensed. The discharge from the squib 40 usually ignites an initiator or igniter material 42 that burns rapidly and exothermically, in turn igniting a gas generant material 50. The gas generant material 50 burns to produce the majority of gas products that are directed to the airbag 36 to provide inflation.

Gas generants are also known as ignition materials, propellants, gas-generating materials, and pyrotechnic materials. The gas generant may be in the form of a solid grain, a pellet, a tablet, or the like. Often, a slag or clinker is formed near the gas generant during burning. The slag/clinker serves to sequester various particulates and other compounds generated by the gas generant during combustion. A filter may be provided between the gas generant and airbag to remove particulates entrained in the gas and to reduce temperature of the gases prior to entering the airbag.

The gas generant includes a fuel, an oxidizer, and may include other minor ingredients, that once ignited combust rapidly to form gaseous reaction products (e.g., $CO_2$, $H_2O$, and $N_2$). One or more compounds undergo rapid combustion to form heat and gaseous products; e.g., the gas generant burns to create heated inflation gas for an inflatable restraint device or to actuate a piston. The gas generant may comprise a redox-couple having at least one fuel component. Depending on whether the fuel is fully or self-oxidized, or under-oxidized, the gas-generating composition may include one or more oxidizing components, where the oxidizing component reacts with the fuel component in order to generate the gas product.

The fuel component may be a nitrogen-containing compound. Typical fuels include tetrazoles and salts thereof (e.g., aminotetrazole, mineral salts of tetrazole), bitetrazoles, 1,2,4-triazole-5-one, guanidine nitrate, nitro guanidine, amino guanidine nitrate, metal nitrates and the like. These fuels are generally categorized as gas generant fuels due to their relatively low burn rates, and are often combined with one or more oxidizers in order to obtain desired burn rates and gas production. In various aspects, the gas generant comprises at least guanidine nitrate as a fuel.

Oxidizers for the gas generant composition include, by non-limiting example, alkali, alkaline earth, and ammonium nitrates, nitrites, and perchlorates; metal oxides; basic metal nitrates; transition metal complexes of ammonium nitrate; and combinations thereof. The oxidizer is selected along with the fuel component to form a gas generant that upon combustion achieves an effectively high burn rate and gas yield from the fuel. Specific examples of suitable oxidizers include basic metal nitrates such as basic copper nitrate. Basic copper nitrate has a high oxygen-to-metal ratio and good slag forming capabilities upon burn. Such oxidizing agents may be present in an amount of less than or equal to about 50% by weight of the gas-generating composition.

Other oxidizers include water soluble oxidizing compounds, such as nitrates or perchlorates, for example ammonium, sodium, strontium or potassium nitrate, and ammonium, sodium or potassium perchlorate. Also included are ammonium dinitramide and perchlorate-free oxidizing agents. The gas generant may include combinations of oxidizers, such that the oxidizers may be nominally considered a primary oxidizer, a second oxidizer, and the like. For example, at least one fuel component, such as guanidine nitrate, may be mixed with a combination of oxidizers, such as basic copper nitrate and potassium perchlorate, to form a gas generant.

The gas-generating composition may be formed from an aqueous dispersion of the redox-couple where one or more fuel components are added to an aqueous solution to be substantially dissolved and the oxidizer components are dispersed and stabilized in the fuel solution, either dissolved in the solution themselves, or present as a stable dispersion of solid particles. The solution or dispersion may also be in the form of a slurry. The aqueous dispersion or slurry is spray-dried by passing the mixture through a spray nozzle in order to form a stream of droplets. The droplets contact hot air to effectively remove water and any other solvents from the droplets and subsequently produce solid particles of the gas generant composition.

The mixture of components forming the aqueous dispersion may also take the form of a slurry, where the slurry is a flowable or pumpable mixture of fine (relatively small particle size) and substantially insoluble particle solids suspended in a liquid vehicle or carrier. Mixtures of solid materials suspended in a carrier are also contemplated. In some embodiments, the slurry comprises particles having an average maximum particle size of less than about 500 μm, optionally less than or equal to about 200 μm, and in some cases, less than or equal to about 100 μm.

The slurry contains flowable and/or pumpable suspended solids and other materials in a carrier. Suitable carriers include aqueous solutions that may be mostly water; however, the carrier may also contain one or more organic solvents or alcohols. In some embodiments, the carrier may include an azeotrope, which refers to a mixture of two or more liquids, such as water and certain alcohols that desirably evaporate in constant stoichiometric proportion at specific temperatures and pressures. The carrier should be selected for compatibility with the fuel and oxidizer components to avoid adverse reactions and further to maximize solubility of the several components forming the slurry. Non-limiting examples of suitable carriers include water, isopropyl alcohol, n-propyl alcohol, and combinations thereof.

Viscosity of the slurry is such that it can be injected or pumped during the spray drying process. In some embodiments, the viscosity is kept relatively high to minimize water and/or solvent content, for example, so less energy is required for carrier removal during spray drying. However, the viscosity may be lowered to facilitate increased pumping rates for higher pressure spray drying. Such adjustments may be made when selecting and tailoring atomization and the desired spray drying droplet and particle size.

In some embodiments, the slurry has a water content of greater than or equal to about 15% by weight and may be greater than or equal to about 20%, 30%, or 40% by weight. In some embodiments, the water content of the slurry is about 15% to 85% by weight. As the water content increases, the viscosity of the slurry decreases, thus pumping and handling become easier. In some embodiments, the slurry has a viscosity ranging from about 50,000 to 250,000 centipoise. Such viscosities are believed to be desirable to provide suitable rheological properties that allow the slurry to flow under applied pressure, but also permit the slurry to remain stable.

In some embodiments, a quantity of silica ($SiO_2$) is included in the aqueous dispersion, which can act as an oxidizer component but also serves to thicken the dispersion and reduce or prevent migration of solid oxidizer particles in the bulk dispersion and droplets. The silica can also react with the oxidizer during the redox reaction to form a glassy slag that is easily filtered out of the gas produced upon ignition of the gas generant. The silica is preferably in very fine form. In certain embodiments, preferable grades of silica include those having particle sizes of about 7 nm to about 20 nm, although in certain aspects, silica having particles sizes of up to about 50 μm may be employed as well. Equivalent and equally useful slag and viscosity modifying/promoting agents include cerium oxide, ferric oxide, zinc oxide, titanium oxide, zirconium oxide, bismuth oxide, molybdenum oxide, lanthanum oxide and the like. Such redox inert oxides maybe employed individually or as mixtures of two or more individual components. For example, where one oxide has a very fine form (e.g., particle size of less than about 20 nm) useful for improving viscosity of the mixture slurry, another coarser oxide having larger particle sizes may be provided to the mixture to improve slagging properties without interfering with or negatively affecting burning rate.

In certain aspects, the gas generant may include about 30-70 parts by weight, more preferably 40-50 parts by weight, of at least one fuel (e.g., guanidine nitrate), about 30-60 parts by weight of oxidizers (e.g., basic copper nitrate and potassium perchlorate), and about 0-5 parts by weight of slag forming agents like silica ($SiO_2$) or equivalents thereof. In forming the aqueous dispersion, the composition is mixed with sufficient aqueous solution to dissolve substantially the entire fuel component at the spray temperature; however, in certain aspects, it is desirable to restrict the amount of water to a convenient minimum in order to minimize the amount of water that is to be evaporated in the spray-drying process. For example, the dispersion may have less than or equal to about 100 parts by weight of water for about 30-45 parts by weight of fuel component.

The oxidizer components may be uniformly dispersed in the fuel solution by vigorous agitation to form the dispersion, where the particles of oxidizer are separated to a sufficient degree to form a stable dispersion. In the case of water insoluble oxidizers, the viscosity will reach a minimum upon achieving a fully or near fully dispersed state. A high shear mixer may be used to achieve efficient dispersion of the oxidizer particles. The viscosity of the dispersion should be sufficiently high to prevent any substantial migration (i.e., fall-out or settling) of the solid particles in the mixture.

The spray drying process is used for forming particles and drying materials. It is suited to continuous production of dry solids in powder, granulate, or agglomerate particle forms using liquid feedstocks of the redox couple components to make the gas generant. Spray drying can be applied to liquid solutions, dispersions, emulsions, slurries, and pumpable suspensions. Variations in spray drying parameters may be used to tailor the dried end-product to precise quality standards and physical characteristics. These standards and characteristics include particle size distribution, residual moisture content, bulk density, and particle morphology.

Spray drying includes atomization of the aqueous mixture, for example, atomization of the liquid dispersion of redox couple components into a spray of droplets. The droplets are then contacted with hot air in a drying chamber. Evaporation of moisture from the droplets and formation of dry particles proceeds under controlled temperature and airflow conditions. Powder may be continuously discharged from the drying chamber and recovered from the exhaust gases using, for example, a cyclone or a bag filter. The whole process may take no more than a few seconds. In some embodiments, the liquid dispersion or slurry is heated prior to atomization.

A spray dryer apparatus typically includes a feed pump for the liquid dispersion, an atomizer, an air heater, an air disperser, a drying chamber, a system for powder recovery, an exhaust air cleaning system, and a process control system. Equipment, process characteristics, and quality requirements may be adjusted based on individual specifications. Atomization includes forming sprays having a desired droplet size distribution so that resultant powder specifications may be met. Atomizers may employ various approaches to droplet formation and include rotary (wheel) atomizers and various types of spray nozzles. For example, rotary nozzles provide atomization using centrifugal energy, pressure nozzles provide atomization using pressure energy, and two-fluid nozzles provide atomization using kinetic energy.

Airflow adjustment may be used to control the initial contact between spray droplets and the drying air in order to control evaporation rate and product temperature in the dryer. Co-current airflow moves drying air and droplets/particles through the drying chamber in the same direction. In co-current airflow, product temperature on discharge from the dryer is lower than the exhaust air temperature and the method therefore works well for drying heat sensitive products. Counter-current airflow moves drying air and droplets or particles through the drying chamber in opposite directions and is useful for products that require heat treatment during drying. The temperature of the powder leaving counter-current airflow drying is usually higher than the exhaust air temperature. Mixed flow combines co-current and counter-current airflow so that droplets or particles experience both types of airflow. The mixed flow method is used for heat stable products where coarser powder requirements require the use of nozzle atomizers. Mixed flow methods include spraying upwards into an incoming airflow, or for heat sensitive particles the atomizer sprays downwards toward an integrated fluid bed, and typically the air inlet and outlet are located at the top of the drying chamber.

The aqueous dispersion of gas generant components may be atomized using a spray nozzle to form droplets of about 40 μm to 200 μm in diameter by forcing the droplets under pressure through a nozzle having one or more orifices of about 0.5 mm to 2.5 mm in diameter. The droplets may be spray-dried by allowing the droplets to fall into or otherwise contact a stream of hot air at a temperature in the range from about 80° C. to 250° C., preferably about 80° C. to 180° C. The outlet and inlet temperatures of the air stream may be different in order to achieve the heat transfer required for drying the droplets. The preceding illustrative air temperature ranges are further indicative of examples of outlet and inlet temperatures, respectively.

The present methods may employ various spray driers as known in the art. For example, suitable spray drying apparatuses and accessory equipment include those manufactured by Anhydro Inc. (Olympia Fields, Ill.), BUCHI Corporation (New Castle, Del.), Marriott Walker Corporation (Birmingham, Mich.), Niro Inc. (Columbia, Md.), and Spray Drying Systems, Inc. (Eldersburg, Md.). In certain aspects, a suitable spray drying process to form powdered or particulate materials includes those processes described in U.S. Pat. No. 5,756,930 to Chan et al, the relevant portion of which is incorporated herein by reference.

Particles produced from the spray-dried droplets may comprise aggregates of very fine mixed crystals of the gas generant components, having a primary crystal size of about 0.5 μm to about 5 μm in the thinnest dimension, and preferably about 0.5 μm to about 1 μm. However, water insoluble oxidizer components are preferred as these can be obtained in very small particle sizes and incorporated in the aqueous solution of dissolved fuel component to form a dispersion, thereby reducing the water content required for the aqueous medium.

The dried particles of gas generant may take the form of substantially spherical microporous aggregates of fuel crystals (e.g., guanidine nitrate crystals) having a narrow size distribution within the range required for substantially complete reaction with the oxidizers. For example, the spherical microporous aggregates may be about 20 μm to about 100 μm in diameter, the primary fuel crystals being about 0.5 μm to about 5 μm and generally about 0.5 μm to 1 about μm in the thinnest dimension. Generally, particles of the solid oxidizer(s) are encapsulated by the fuel crystals, where the oxidizer particles serve as crystal growth sites for the fuel component crystals. The spray drying process produces very little ultrafine dust that could be hazardous in subsequent processing operations.

The dried particles of gas generant may be readily pressed into pellets or grains for use in a gas-generating charge in inflatable restraints; e.g., air-bags. The pressing operation may be facilitated by mixing the spray-dried gas generant particles with a quantity of water or other pressing aid, such as graphite powder, calcium stearate, magnesium stearate and/or graphitic boron nitride, by way of non-limiting example. The water may be provided in the form of a mixture of water and hydrophobic fumed silicon, which may be mixed with the particles using a high shear mixer. The composition may then be pressed into various forms, such as pellets or grains. In certain embodiments, suitable gas generant grain densities are greater than or equal to about 1.8 g/cc and less than or equal to about 2.2 g/cc. These pellets and granular forms are readily ignited by an igniter, such as an electric squib, or in certain aspects, more efficiently, by an igniferous booster comprising pyrotechnic sheet material. The pyrotechnic sheet material may be formed of an oxidizing film, for example, a film of polytetrafluoroethylene coated with a layer of oxidizable metal, such as magnesium, as described in European Patent Publication No. 0505024 to Graham et al., the relevant portions of which is incorporated by reference.

In some embodiments, methods of making a gas generant use a processing vessel, such as a mix tank, in order to prepare the gas generant formulation that is subsequently processed by spray drying. For example, the processing vessel may be charged with water, guanidine nitrate, and oxidizers including basic copper nitrate and potassium perchlorate, which are mixed to form an aqueous dispersion. The temperature of the slurry may be equilibrated at about 80° C. to 90° C. for approximately one hour. Additives and components, such as additional fuel components, oxidizer components, slagging aids, etc., may be added to the reaction mixture at this time. The resulting aqueous dispersion is then pumped to the spray drier to form the dry powder or particulate gas generant product. Further processing steps such as blending, pressing, igniter coating, etc. or the like can then be preformed per standard procedures.

The present spray drying methods produce unexpectedly high burning rates for gas generant compositions containing guanidine nitrate, basic copper nitrate, and about 1% to about 15% by weight of a co-oxidizer, such as potassium perchlorate. These burn rates are surprising when compared to comparative gas generants formed by using the same components and having substantially the same composition, but prepared using different processes. For example, spray drying of these mixtures may result in compositions exhibiting burning rates at least about 20% greater than a comparative burn rate of a comparative gas generant having substantially the same compositions prepared by a process selected from: mechanically blending followed by roll compacting the individual ingredients, milling, and/or mechanical blending of the potassium perchlorate into a spray dried mixture of basic copper nitrate and guanidine nitrate, which are conventional processes used to form gas generant grains. In certain aspects, gas generant compositions prepared by the present spray drying methods provide the ability to utilize inexpensive ingredients, while exhibiting burn rates comparable to burn rates previously achieved only through incorporation of expensive ingredients such as bitetrazole and aminotetrazole. The present methods and formulations may also include additional additives such as silica or similar inert oxides for promoting slag formation during combustion of the generant.

Thus, in various aspects, the present teachings provide a gas generant grain comprising guanidine nitrate, basic copper nitrate, and about 1% to about 30% by weight of a secondary oxidizer, where the gas generant grain has a linear burn rate of greater than or equal to about 1 inch per second (about 38.1 mm per second) at a pressure of about 3,000 pounds per square inch (about 20.7 MPa). In certain aspects, the gas generant has a linear burn rate of greater than or equal to about 1.1 inches per second (about 28 mm/Sec); optionally greater than or equal to about 1.2 inches per second (about 30.5 mm/Sec); optionally greater than or equal to about 1.3 inches per second (about 33 mm/Sec); optionally greater than or equal to about 1.4 inches per second (about 36 mm/Sec); optionally greater than or equal to about 1.5 inches per second (about 38 mm/Sec); optionally greater than or equal to about 1.6 inches per second (about 41 mm/Sec); optionally greater than or equal to about 1.7 inches per second (about 43 mm/Sec); optionally greater than or equal to about 1.8 inches per second (about 46 mm/Sec); and optionally greater than or equal to about 1.9 inches per second (about 48 mm/Sec); at a pressure of about 3,000 pounds per square inch (psi) (about 20.7 MPa). In certain embodiments, the linear burn rate of the gas generant is greater than or equal to about 2.0 inches per second (about 51 mm/Sec) at a pressure of about 3,000 psi (about 20.7 MPa). In certain embodiments, the burning rate of the gas generant is less than or equal to about 2.1 inches per second (about 53 mm/Sec) at a pressure of 3,000 psi (about 20.7 MPa).

Further, in accordance with the present disclosure, the gas yield of the gas generant is relatively high. For example, in certain embodiments, the gas yield is greater than or equal to about 3 moles/100 grams of gas generant. In certain embodiments, the gas yield is greater than or equal to about 3.1 moles/100 g of gas generant and optionally greater than or equal to about 3.2 moles/100 g of gas generant.

Observed increases in linear burning rates of the spray dried compositions are surprising and unexpected in view of other conventional methods of making gas generants. These process-based enhancements can be observed when comparing examples of data obtained from gas generant formulations prepared using three different methods forming two comparative examples and an example (1) formed in accordance with the present disclosure. The three methods include:

(1) Dry blending the components of guanidine nitrate, basic copper nitrate, and potassium perchlorate, then roll-compacting and milling the gas generant product (Comparative Example 1).

(2) Spray drying the components of guanidine nitrate and basic copper nitrate, then mechanically blending potassium perchlorate into the mixture to form the gas generant product (Comparative Example 2).

(3) Spray drying the components of guanidine nitrate, basic copper nitrate, and potassium perchlorate as a single aqueous mixture to form the gas generant product (Example 1).

Results for these three methods are summarized in Tables 1 and 2. As can be seen, example methods (1) and (2) listed above gave nearly identical results regardless whether the water soluble fuel and principal oxidizer are spray dried or not. While it might be expected that the spray drying in method (2) increases the linear burning rate as compared to that obtained with the dry blending process of method (1), only when the minor oxidizer component of potassium perchlorate is included in the aqueous mixture with the other components and spray dried, as per method (3) of the present teachings, are significant improvements in burning rate achieved. This is further unexpected since potassium perchlorate has only minor solubility in water and the aqueous mixture spray dried in the Example (1) formed in accordance with method (3) is also saturated with respect to guanidine nitrate.

TABLE 1

Process Comparison Example 1

| | Comparative Example (1) Dry Blended | Comparative Example (2) KP*[d] Post Blended | Example (1) Spray Dry with Fountain Nozzle |
|---|---|---|---|
| % Base A*[a] | — | 86.0 | |
| % bCN*[b] | 26.0 | — | 26.0 |
| % GN*[c] | 59.73 (12μ) | — | 59.7 |
| % $SiO_2$ | 0.27 (from GN) | — | 0.3 |
| % KP*[d] (19μ) | 14.0 | 14.0 | 14.0 (unground) |
| Burn Rate (Rb) at 1,000 psi (6.9 MPa) | 0.77 inches per second (ips) 19.6 mm/s | 0.78 ips 19.9 mm/s | 0.99 ips 25.1 mm/s |
| Rb at 3,000 psi (20.7 MPa) | 1.32 ips 33.5 mm/s | 1.38 ips 35.0 mm/s | 1.72 ips 43.7 mm/s |
| burning rate pressure exponent (n) | 0.50 | 0.51 | 0.51 |
| Pressed Density (g/cc) | 1.79 | 1.81 | 1.80 |

*[a]Base A: Spray dried basic copper nitrate, guanidine nitrate and silica.
*[b]basic copper nitrate
*[c]guanidine nitrate
*[d]potassium perchlorate

TABLE 2

Performance Comparison of Samples Made Via Different Processes

| | Comparative Example (1) Dry Blended | Comparative Example (2) KP*[d] Post blended | Example (1) Spray dry with Fountain Nozzle |
|---|---|---|---|
| % Base B*[a] | — | 86.0 | — |
| % bCN*[b] | 26.0 | — | 26.0 |
| % GN*[c] | 57.0 (12μ) | — | 57.0 |
| % $SiO_2$ (M7D) | 3.0 | — | 3.0 |
| % KP*[d] (19μ) | 14.0 | 14.0 | 14.0 (unground) |
| Burn Rate (Rb) at 1,000 psi (6.9 MPa) | 0.68 inches per second (ips) 17.3 mm/s | 0.67 ips 17.0 mm/s | 0.84 ips 21.3 mm/s |
| Rb at 3,000 psi (20.7 MPa) | 1.13 ips 28.7 mm/s | 1.13 ips 28.7 mm/s | 1.50 ips 38.1 mm/s |
| burning rate pressure exponent (n) | 0.47 | 0.53 | 0.49 |
| Pressed Density (g/cc) | 1.79 | 1.82 | 1.84 |

*[a]Base B: Spray dried basic copper nitrate, guanidine nitrate and silica.
*[b]basic copper nitrate
*[c]guanidine nitrate
*[d]potassium perchlorate With reference to Tables 1 and 2, the present methods may be used to make gas generants having increased burn rates relative to comparative gas generants made by other conventional methods. In certain embodiments, the present methods are used to make grains of gas generant that provide a burning rate at least about 20% greater than a comparative gas generant produced by mechanically blending, roll compacting and milling the same amounts of guanidine nitrate, basic copper nitrate, and secondary oxidizer or a gas generant produced by mechanically blending the same amount of secondary oxidizer into a spray dried mixture of the same amounts of basic copper nitrate and guanidine nitrate.

As such, the present methods contemplate spray drying of guanidine nitrate, a principal oxidizer (e.g., basic copper nitrate), and a secondary oxidizer, which results in a gas generant with surprising and unexpected burn rates. Compared with a dry blending method conducted in Comparative Example (1) or a post blending method used to form Comparative Example (2). In accordance with the present teachings, Example (1) is prepared by a method of spray drying all three primary gas generant components, which can increase the burn rate by at least about 25% at 3,000 psi (see e.g., Table 2 above for burning rate). These increased burn rates contrast with methods of spray drying the guanidine nitrate and principal oxidizer followed by dry blending of the secondary oxidizer into the spray dried powder, which in certain aspects, does not appear to afford much, if any, advantage over dry blending all components. Therefore, the present methods and compositions demonstrate particular advantages by including the secondary oxidizer in the spray drying process.

Figure 2:
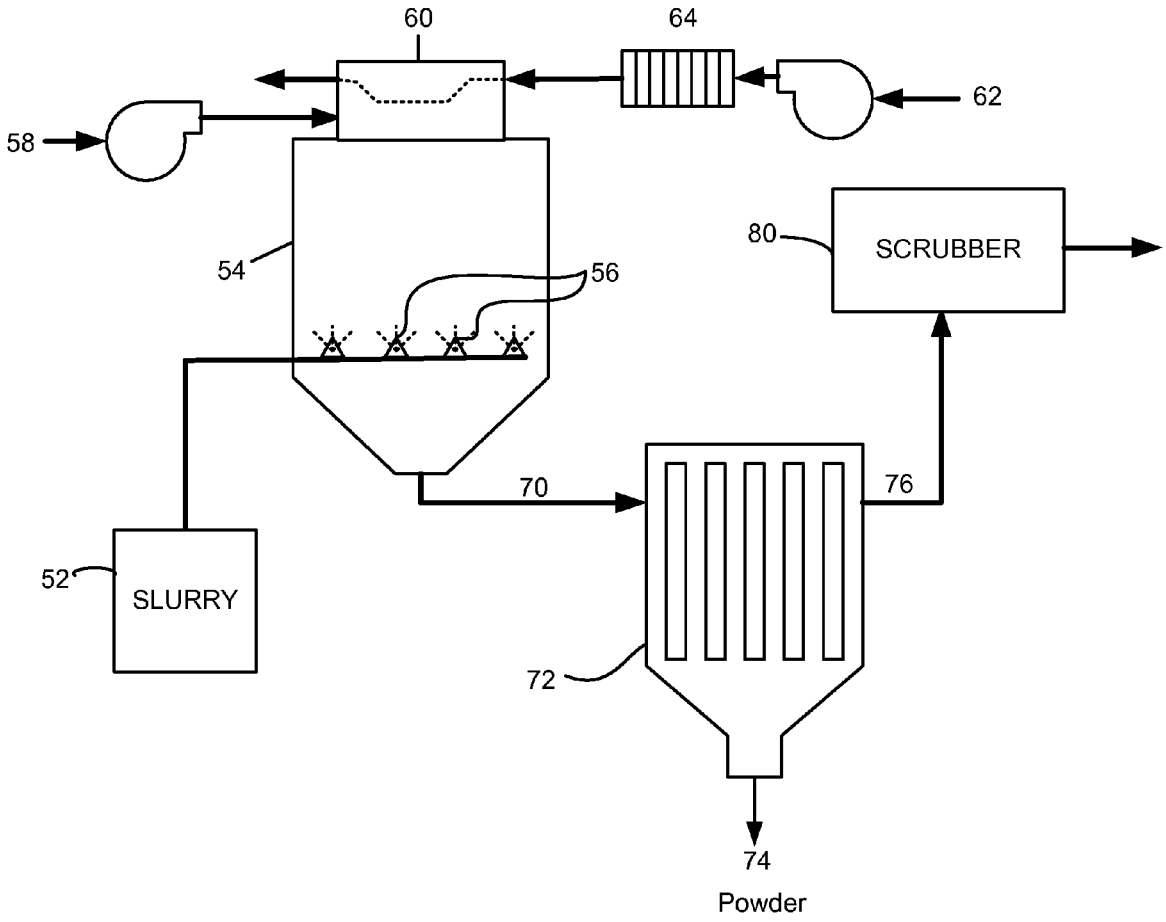
FIG. 2 is a simplified schematic of an exemplary spray drying process.

Spray drying the mixture of guanidine nitrate, principal oxidizer (e.g., basic copper nitrate), and secondary oxidizer (e.g., potassium perchlorate) may be accomplished using various spray drying techniques and equipment. An exemplary simplified spray drying system is shown in FIG. 2. A slurry source 52 contains a slurry comprising the individual components of the gas generant, which is fed to a mixing chamber 54. The slurry is forced through one or more atomizing nozzles 56 at high velocity against a counter current stream of heated air. The slurry is thus atomized and the water removed. The heated air is generated by feeding an air source 58 to a heat exchanger 60, which also receives a heat transfer stream 62. The heat transfer stream 62 may pass through one or more heaters 64. The atomization of slurry in the mixing chamber 54 produces a rapidly dried powder that is entrained in an effluent stream 70. The effluent stream 70 can be passed through a collector unit 72, such as a baghouse or electrostatic precipitator, which separates powder/particulates from gas. The powder 74 is recovered from the collector unit 74 and can then be pelletized, compacted, or otherwise fashioned into a shape suitable for use as a gas generant in an inflating device. The exhaust stream 76 from the separator unit 72 can optionally be passed through one or more processes downstream as necessary, such as a scrubber system 80.

Without wishing to be bound by theory, it is believed that including the secondary oxidizer during particle formation by spray drying results in particles and/or crystals with structures responsible for the advantageous burn rates. Spray drying may be accomplished, for example, using rotary nozzles, pressure nozzles, and two-fluid nozzles as described herein, and parameters such as pressure, flow rate, and airflow may be optimized to achieve desired particle sizes. Thus, gas generants with improved burn rates may be produced using guanidine nitrate, principal oxidizer, and secondary oxidizer by a variety of spray drying techniques.

In certain aspects, the present methods of making gas generants provide additional unexpected benefits based on the selection of spray drying technique employed. In particular, spray drying methods using a single orifice or fountain nozzle spray head are in certain aspects, particularly advantageous in producing a gas generant product that is easier to handle and further process as compared to powder or particulate formed using other spray drying techniques. For example, in certain aspects, powder produced with a single orifice fountain nozzle has better tableting and pressing characteristics. However, the present teachings also provide advantages in various types of spray drying techniques aside from the single orifice fountain spray drying, including spray drying by using two-fluid nozzles, which are also contemplated.

A single orifice fountain nozzle generally sprays only liquid material. An exemplary two-fluid nozzle spray orifice is described by U.S. Pat. No. 5,756,930 to Chan et al., which can also be employed in accordance with the present teachings to process generant to maximize linear burn rate behavior for compositions so processed. The two-fluid nozzle spray orifice used in Chan et al. combines an air nozzle and a liquid nozzle which are sprayed together. The two-fluid nozzle is, by design, intended to impart very high shear forces to the fluid stream and produces minimal product particle size.

Figure 3:
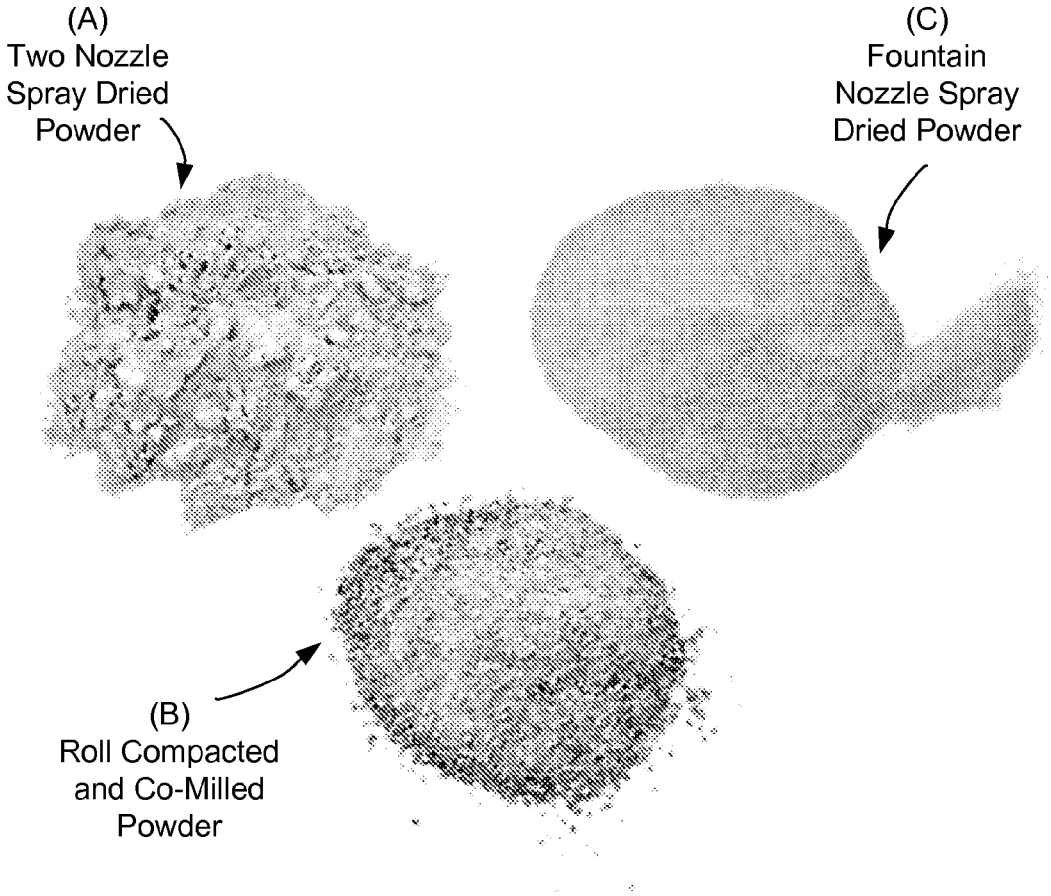
FIG. 3 illustrates gas generant powder produced by (A) two nozzle spray drying, (B) roll compacting and co-milling, and (C) fountain nozzle spray drying.
Figure 4A:
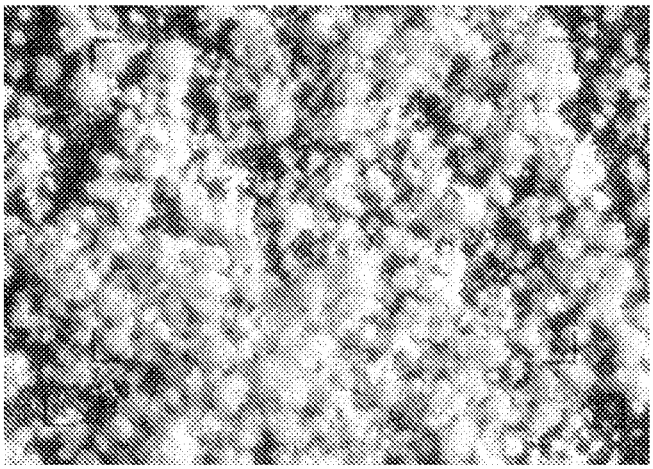
FIGS. 4A and 4B are detailed views (50× magnification) of powders formed in accordance with methods (A) and (C) of FIG. 3, comparing relative size, appearance, and shape of the respective powders.
Figure 4B:
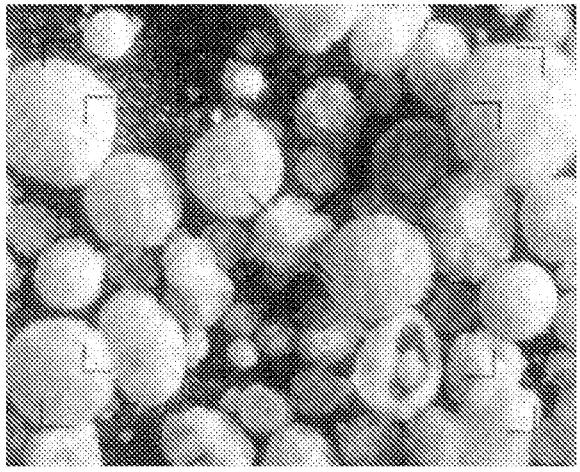

The product produced by the single orifice fountain nozzle, on the other hand, generally has a substantially larger particle size than that produced from the two-fluid nozzle and is particularly suitable for tableting (i.e., pressing or compacting under pressure) without further processing. In certain aspects, this is advantageous compared to powder produced with the two-fluid nozzle, which generally requires further roll compacting and regrinding after spray drying in order to produce a material which can then be tableted. While either the two-fluid nozzle spray drying and single orifice fountain nozzle are suitable for use in accordance with the present disclosure, in certain aspects, gas generant grains made by pressing material produced with the single orifice fountain nozzle spray dry process are particularly suitable, in that they are generally superior in compaction, density, and homogeneity. Examples of the appearance of these three powders and examples of generant grains produced with the same powders are shown in FIGS. 3 and 4A-4B.

In certain embodiments, the gas generant produced by spray drying with a single orifice fountain nozzle has a burn rate similar to the gas generant produced by spray drying with a two-fluid nozzle, where each gas generant is produced using the same aqueous mixture of guanidine nitrate, basic copper nitrate, and potassium perchlorate. However, the material produced using the single orifice fountain nozzle results in more rounded particles that are easier to handle and press, as shown by comparative views in FIGS. 4A and 4B. FIG. 4A shows powders formed via spray drying with a two-fluid nozzle and FIG. 4B shows powders formed by spray drying with a fountain nozzle, which have a relatively larger particle size and a more rounded shape. Spray dried product particle sizes of about 100 μm to 200 μm may be easier to handle and feed to tablet press, such as those formed in the fountain nozzle spray drying methods.

In various aspects, the present methods may be used to produce a high burning rate gas generant composition including guanidine nitrate, basic copper nitrate, and from about 1% to 30% by weight of a secondary oxidizer such as potassium perchlorate. The composition may also include up to about 5% by weight of a slag promoter such as silicon dioxide. The process includes forming an aqueous mixture of the components by first completely dissolving the guanidine nitrate and then adding the basic copper nitrate and potassium perchlorate to the aqueous mixture to produce a slurry. The slurry is spray dried with a single orifice fountain nozzle to produce a freely flowing powder. The resulting powder is pressed into tablets, cylinders, or other geometries to produce grains suitable for use as a gas generant in an inflatable restraint system.

In some embodiments, the aqueous mixture may include one or more additional metal oxides such as cupric oxide, molybdenum oxide, iron oxide, bismuth oxide the like in addition to the basic copper nitrate. In addition to potassium perchlorate, or in substitution thereof, co-oxidizers such as ammonium perchlorate, potassium nitrate, strontium nitrite, and sodium nitrate may be used. Alternate slag promoters that may be used include zinc oxide, aluminum oxide, cerium oxide, and similar compounds. Pressing agents such as calcium or magnesium stearate, graphite, molybdenum disulfide, tungsten disulfide, boron nitride, and mixtures thereof may also be added prior to tableting or pressing.

Figure 5:
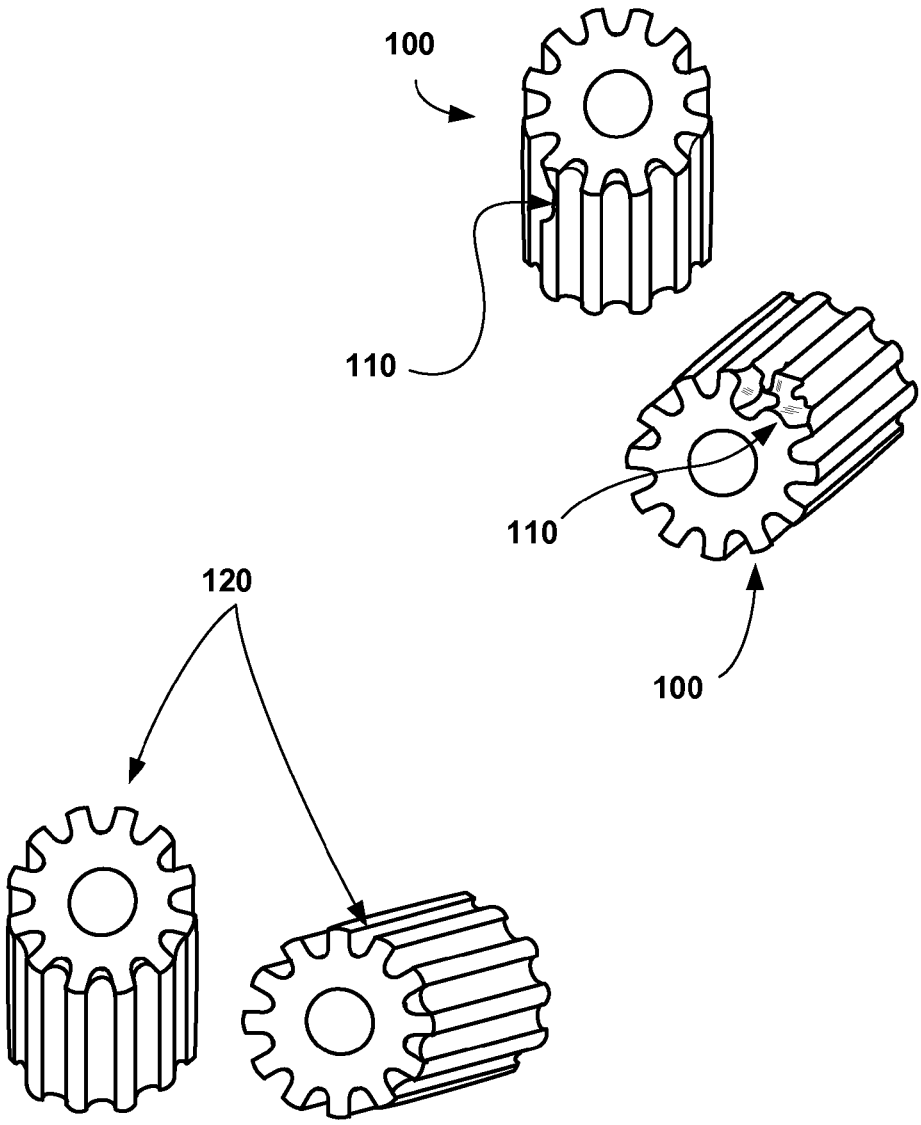
FIG. 5 illustrates gas generant grains made using the powders formed via methods (A) and (C) in FIG. 3.

Resulting tablets and pellets produced using material from single orifice fountain nozzle have fewer physical defects, such as voids and chips of the gas generant grain or pellet, as compared to tablets and pellets produced using material from two-fluid nozzle. As shown in FIG. 5, gas generant grains 100 formed by pressing powder formed from two-nozzle spray drying may exhibit some void and chip defects 110 when made under certain processing conditions, as compared to gas generant grains 120 formed by pressing powder formed via fountain nozzle spray drying, which do not have such physical defects (FIG. 5).

EXAMPLE 2

The following Table 3 shows the effect of substituting other metal oxides for fine silica ($SiO_2$ used in formulations of Tables 1 and 2) in one embodiment of a gas generant composition of the present disclosure. The compositions are prepared by mixing 57% by weight guanidine nitrate, 26% by weight basic copper nitrate, 14% by weight 20 μm potassium perchlorate and 3% of the inert oxide material together in water and drying the mixture at 70° C. Once dry, the burning rate of the material is determined. As Table 3 shows, very fine silica and fine alumina, appear to suppress the burning rate of the generant relative to the other additives. Thus, in certain aspects, selection of combinations of fine silica or alumina with one or more other metal oxides may be desirable from a performance point of view to achieve desirable burn rates.

TABLE 3

Performance Comparison of Generants Having Different Slag Promoting Metal Oxides

| Additive | % by wt. | Burn Rate (Rb) at 1,000 psi (6.9 MPa) | Rb at 3,000 psi (20.7 MPa) | Burning rate pressure exponent (n) |
|---|---|---|---|---|
| $SiO_2$ (fine) | 3 | 0.52 | 0.83 | 0.43 |
| $Al_2O_3$ (fine) | 3 | 0.44 | 0.84 | 0.61 |
| ZnO reagent | 3 | 0.65 | 1.04 | 0.43 |
| $TiO_2P_25$ | 3 | 0.58 | 0.95 | 0.46 |
| $La_2O_3$ | 3 | 0.64 | 1.03 | 0.44 |
| $ZrO_2$ | 3 | 0.65 | 1.06 | 0.44 |
| $Bi_2O_3$ | 3 | 0.69 | 1.11 | 0.44 |
| $Fe_2O_3$ | 3 | 0.63 | 1.01 | 0.43 |
| $CeO_2$ | 3 | 0.67 | 1.06 | 0.42 |

The examples and other embodiments described above are not intended to be limiting in describing the full scope of compositions and methods of this technology. Equivalent changes, modifications and variations of specific embodiments, materials, compositions, and methods may be made within the scope of the present disclosure with substantially similar results.

What is claimed is:

1. A method for making a gas generant comprising:

forming an aqueous mixture by mixing together guanidine nitrate, basic copper nitrate, about 1% to about 30% by weight of a secondary oxidizer comprising a perchlorate salt, and an aqueous medium comprising water;

spray drying the aqueous mixture to produce a powder, wherein the powder comprises the guanidine nitrate, the basic copper nitrate, and the secondary oxidizer comprising the perchlorate salt; and pressing the powder to produce a gas generant grain.

2. The method of claim 1, wherein the aqueous mixture includes about 1% to about 15% by weight of said secondary oxidizer.

3. The method of claim 1, wherein the secondary oxidizer comprises potassium perchlorate.

4. The method of claim 1, wherein the aqueous mixture further comprises at least one additive.

5. The method of claim 4, wherein the additive is a metal oxide.

6. The method of claim 5, wherein the metal oxide comprises a compound selected from the group consisting of: cupric oxide, molybdenum oxide, iron oxide, bismuth oxide, and combinations thereof.

7. The method of claim 1, wherein the aqueous mixture further comprises less than or equal to about 5% by weight of a slag promoting agent.

8. The method of claim 7, wherein the slag promoting agent comprises a compound selected from the group consisting of: silicon dioxide, zinc oxide, aluminum oxide, cerium oxide, and combinations thereof.

9. The method of claim 1, further comprising adding less than or equal to about 5% by weight of a slag promoting agent to the powder prior to the pressing.

10. The method of claim 9, wherein the slag promoting agent comprises a compound selected from the group consisting of: silicon dioxide, zinc oxide, aluminum oxide, cerium oxide, and combinations thereof.

11. The method of claim 1, wherein the forming the aqueous mixture further comprises adding the guanidine nitrate to the aqueous medium;

followed by adding the basic copper nitrate and the secondary oxidizer to the aqueous medium; and mixing the aqueous medium to form the aqueous mixture.

12. The method of claim 1, wherein said spray drying of the aqueous mixture to produce the powder is performed using a single orifice fountain nozzle.

13. The method of claim 1, wherein the pressing of the powder forms gas generant grains having a shape selected from tablets or cylinders.

14. The method of claim 1, further comprising adding a pressing agent to the powder prior to the pressing to form the gas generant grain.

15. The method of claim 14, wherein the pressing agent is selected from the group consisting of calcium stearate, magnesium stearate, graphite, molybdenum disulfide, tungsten disulfide, boron nitride, and combinations thereof.

16. A method for making a gas generant comprising:

spray drying an aqueous mixture via a single orifice fountain nozzle to produce a powder having an average particle size of about 100 μm to about 200 μm, wherein said aqueous mixture comprises guanidine nitrate, basic copper nitrate, and about 1% to about 30% by weight of a secondary oxidizer selected from the group consisting of: potassium perchlorate, ammonium perchlorate, potassium nitrate, strontium nitrate, sodium nitrate, and combinations thereof; and pressing the powder to produce a gas generant grain having an average linear burn rate of greater than or equal to about 1.5 inches per second (about 38.1 mm per second) at a pressure of about 3,000 pounds per square inch (about 20,685 kPa).

17. A method for making a gas generant comprising:

forming an aqueous mixture by mixing together guanidine nitrate, basic copper nitrate, about 1% to about 30% by weight of a secondary oxidizer selected from the group consisting of: potassium perchlorate, ammonium perchlorate, potassium nitrate, strontium nitrate, sodium nitrate, and combinations thereof, and an aqueous medium comprising water;

spray drying the aqueous mixture to produce a powder comprising guanidine nitrate, basic copper nitrate, and the secondary oxidizer; and pressing the powder to produce a gas generant grain.

18. The method of claim 1, wherein the aqueous mixture consists essentially of guanidine nitrate, basic copper nitrate, the secondary oxidizer comprising the perchlorate salt, the aqueous medium comprising water, and optionally an additive selected from the group consisting of: a metal oxide, a slag promoting agent, and combinations thereof.

19. The method of claim 17, wherein the aqueous mixture consists essentially of guanidine nitrate, basic copper nitrate, the secondary oxidizer, the aqueous medium comprising water, and optionally an additive selected from the group consisting of: a metal oxide, a slag promoting agent, and combinations thereof.

* * * * *